US007503259B2

(12) United States Patent
Howard

(10) Patent No.: US 7,503,259 B2
(45) Date of Patent: Mar. 17, 2009

(54) ANTI-SUBMARINE WARFARE CLUSTER MUNITIONS AND CLUSTER DEPTH CHARGES

(75) Inventor: Robert J. Howard, Clifton, VA (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 11/057,822

(22) Filed: Feb. 15, 2005

(65) Prior Publication Data

US 2006/0180044 A1 Aug. 17, 2006

(51) Int. Cl.
*F42B 21/00* (2006.01)
*F42B 19/04* (2006.01)
*F42B 19/06* (2006.01)

(52) U.S. Cl. ..... 102/391; 114/21.3; 114/25

(58) Field of Classification Search ..... 102/390, 102/391; 114/21.3, 25
See application file for complete search history.

(56) References Cited

U.S. PATENT DOCUMENTS 1,217,016 A 2/1917 Krivohlany
1,382,166 A * 6/1921 Blum ..... 102/390
2,412,223 A * 12/1946 Merrill ..... 114/20.1
3,083,667 A * 4/1963 Hickerson ..... 114/25
3,088,403 A * 5/1963 Bartling et al. ..... 102/399
3,648,636 A * 3/1972 Mentcher et al. ..... 114/23
3,738,270 A * 6/1973 Hargett et al. ..... 114/20.1
3,745,956 A * 7/1973 Bertheas ..... 114/23
3,875,552 A * 4/1975 Hogman et al. ..... 367/1
4,079,687 A * 3/1978 Mentcher ..... 114/20.1
4,372,239 A * 2/1983 Hagelberg et al. ..... 114/20.2
4,505,442 A * 3/1985 Kirsch et al. ..... 244/3.15
5,012,717 A * 5/1991 Metersky et al. ..... 89/1.11
5,442,358 A * 8/1995 Keeler et al. ..... 342/54
5,955,698 A 9/1999 Harkins et al.
6,378,801 B1 * 4/2002 Pell et al. ..... 244/3.24
6,766,745 B1 7/2004 Kuklinski
2004/0065247 A1 4/2004 Horton
2004/0069176 A1 4/2004 Kellner
2004/0134336 A1 7/2004 Solomon
2004/0134337 A1 7/2004 Solomon

* cited by examiner

*Primary Examiner*—Bret Hayes
(74) *Attorney, Agent, or Firm*—Schwegman, Lundbert & Woessner, P.A.

(57) ABSTRACT

A system of cluster depth charges increases the probability of inflicting damage on an underwater target. In an embodiment, the cluster depth charges are within a housing, and have intelligent sensor, buoyancy, and tracking and homing systems. In another embodiment, the cluster depth charges have a gun attached to a buoyancy section. In another embodiment, the cluster depth charges have magnets so that the cluster depth charges can attach to the target.

13 Claims, 4 Drawing Sheets

ANTI-SUBMARINE WARFARE CLUSTER MUNITIONS AND CLUSTER DEPTH CHARGES

TECHNICAL FIELD

The invention relates to weapons that are used against submarines and other underwater targets, and in particular, depth charges and depth charge-like munitions.

BACKGROUND

Submarines, in one form or another, have been used in military operations since the time of the U.S. Civil War. As with any military vehicle, there are weapons that are presently available to counteract submarines. The most common weapons that have been used to counter attack submarines are depth charges and torpedoes. However, depth charges and torpedoes are not entirely effective. Depth charges, for a variety of reasons, are notoriously ineffective. Torpedoes are costly, bulky, and generally require either a very good fire control system or some type of manual intervention. Consequently, military units seeking to counteract an enemy submarine incursion are in need of improved weapons to combat such submarines.

SUMMARY OF AN EMBODIMENT

An embodiment of the invention is a cluster depth charge (CDC). A cluster depth charge is made up of a plurality of relatively small weapons that are deployed into water in which a target resides. The payloads of the CDC include simple explosives, shaped charges that may attach onto the target, and projectiles. The CDCs may be deployed off a surface vessel, dropped from an aircraft, and/or fired with a rocket propelled projectile. The CDCs may be deployed to form a cluster field by deploying them one at a time, several at a time, all at once, and/or all at once in a housing which later disintegrates to release the CDCs and form the cluster field. In an embodiment, the CDCs have intelligent sensor, seeking, and guidance systems that cause each CDC to gravitate towards the target. In one embodiment, the CDC attaches to the target and then detonates. In another embodiment, the CDC orients itself in proximity to the CDC and fires a projectile at the target.

It is an object of an embodiment of the invention to improve upon implements and methods to counter attack submarines and other underwater targets.

DETAILED DESCRIPTION OF AN EMBODIMENT

Figure 1:
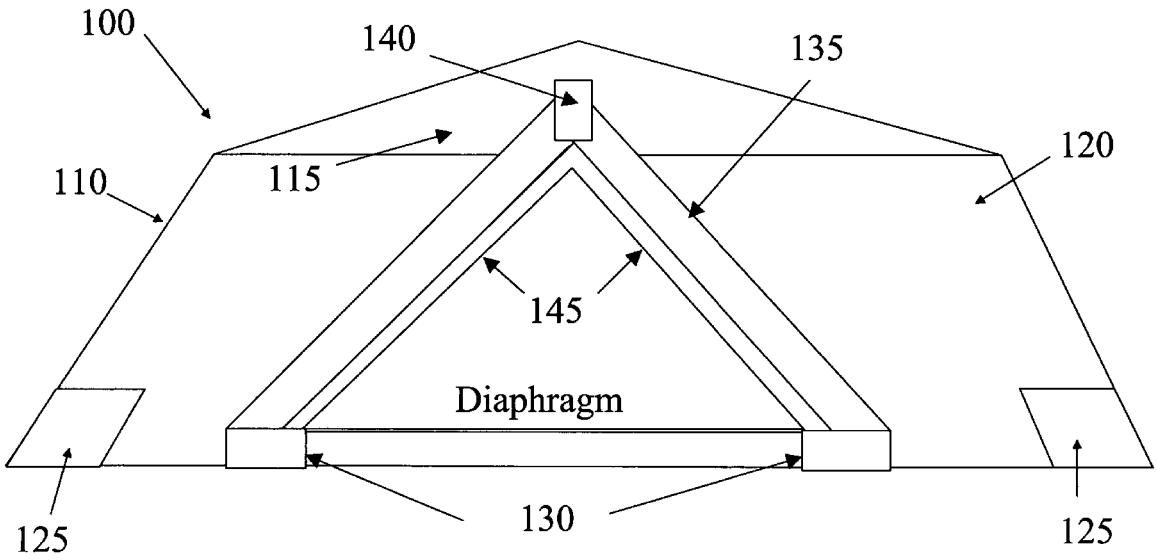
FIG. 1 illustrates an embodiment of a cluster depth charge of the invention.

An embodiment of the invention is illustrated in FIG. 1. Specifically, FIG. 1 illustrates a shaped charge weapons payload 100. The payload 100 has an outer housing 110. Within the housing 110 is a buoyancy control section 115, a tracking and homing system 120, sensor(s) 125, and magnet(s) 130. Also within the housing 10 is a shaped explosive charge 135, and a detonator 140. The shaped explosive charge 135 is supported by a cone shaped support 145. See FIG. 1*a*. When a plurality of payloads 100 are deployed in a body of water, they may be referred to as cluster depth charges (CDCs).

Figure 1A:
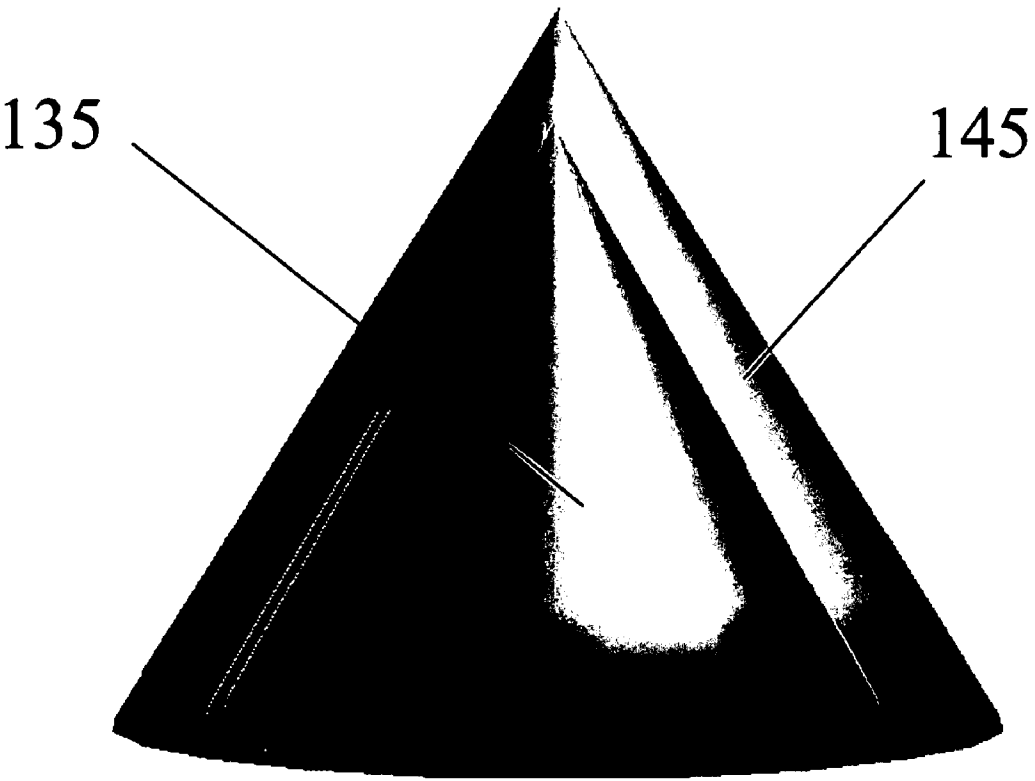
FIG. 1*a* illustrates an embodiment of a shaped charge weapons payload that may be used in connection with an embodiment of the invention.

In the embodiment of the invention of FIGS. 1 and 1*a*, a CDC could attach to a submarine hull via the use of the magnet(s) 130. In another embodiment, one or more of the CDCs propel a jet of molten metal through the hulls of the submarine. Such a hole need not be extensive for the CDCs to be effective against the submarine. Indeed, even a hole that is less than an inch in diameter could result in fatal consequences for a submarine that is at a depth of 100 meters.

Figure 2:
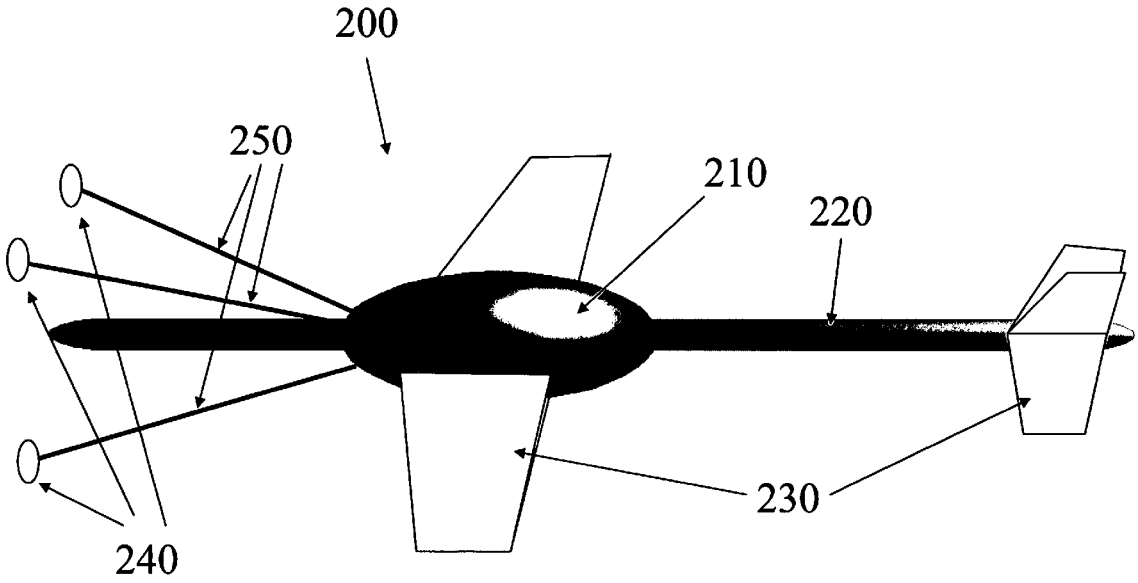
FIG. 2 illustrates another embodiment of a cluster depth charge of the invention.

Another embodiment of the invention is illustrated in FIG. 2. FIG. 2 illustrates a super-cavitating projectile (also referred to as cavitating projectiles or simply projectiles) payload 200. In an embodiment, the projectile payload 200 may be deployed in a cluster fashion like the shaped charge weapons payload 100. The projectile payload 200 has a body 210 within which are sensors, guidance systems, and buoyancy sections. The intelligent guidance algorithms of these sensors, guidance systems, and buoyancy sections permit the projectile payload 200 to acquire a contact, estimate the closest point of approach (CPA), and plot an intercept course. The projectile payload 200, as well as the shaped CDCs, also have intelligent systems to manage trigger modes and attack profiles and well as to control the buoyancy and maneuvering systems. In this and other embodiments, the CDC may trigger on contact with a target. Additionally, in this and other embodiments, the projectile payload 200 and the shaped CDCs may be programmed to trigger on a particular course, at a particular speed, and/or at a particular depth, depth range, or change in depth. Attached to the body 210 is a gun barrel 220. Control (or guidance) surfaces 230 are attached to both the body 210 and the gun barrel 220. Magnetic attachment fixtures 240 are connected to the body 210, and when deployed as shown in FIG. 2, extend out from the body 210 via extensible rods 250.

Figure 3:
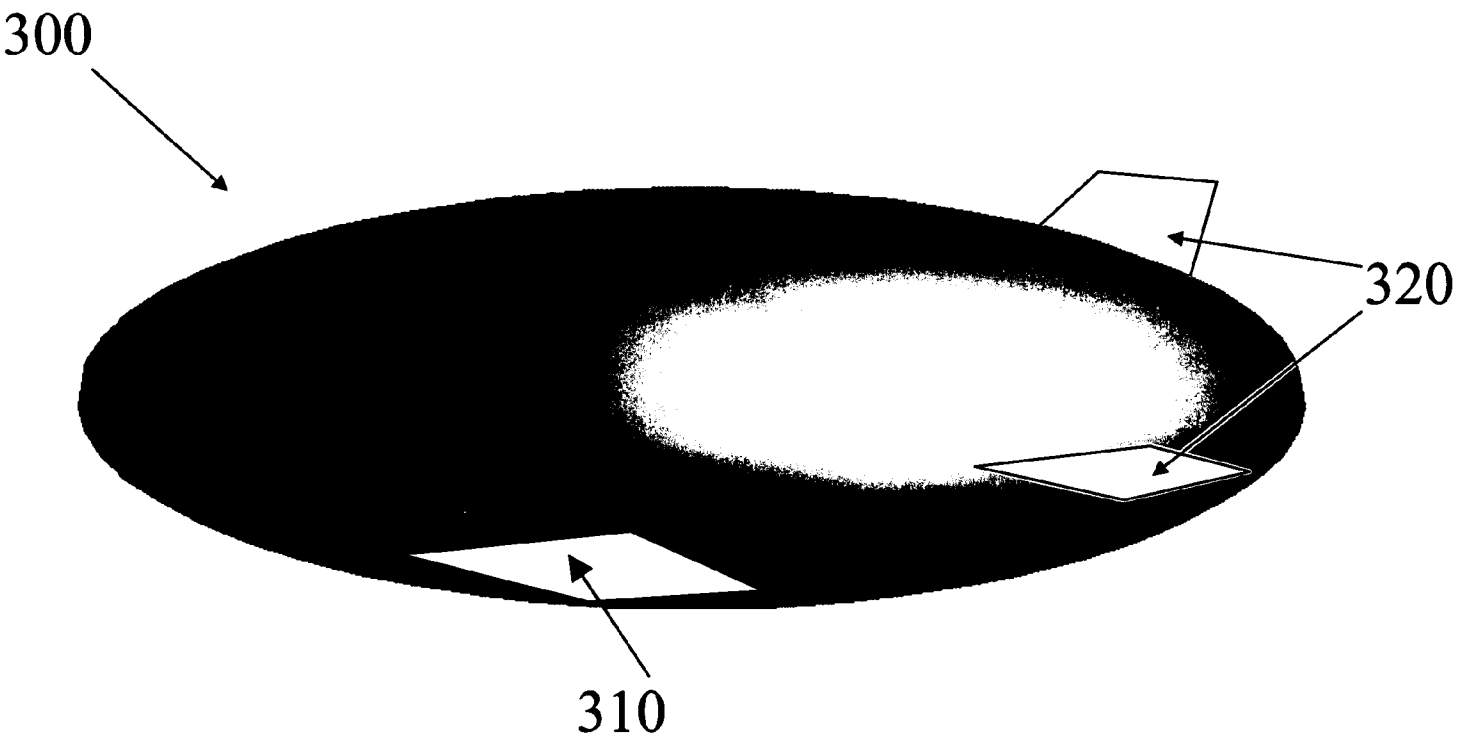
FIG. 3 illustrates a lifting body that can be used in connection with an embodiment of a cluster depth charge of the invention.

In an embodiment, a CDC may contain a number of weapons payloads 100 and/or projectiles 200. When deployed, if the CDC successfully attaches to a submarine's hull, then the cavitating projectile could fire at the hull, thereby blowing a hole through the hull. If attachment failed, a CDC having projectiles could fire the projectiles at the submarine in rapid succession as the submarine passes the closest point of approach. Such an embodiment extends the coverage and lethality of the CDCs since contact with or attachment to the submarine or target is not essential. In a particular embodiment, one or more cavitating projectiles 200 are contained within a form of a hydrodynamic glider 300 with a bulbous sensor section 310 and stubby winglets 320. See FIG. 3.

The shaped charge weapons payload 100 and the projectile payload 200 may be deployed in several ways. They can be air dropped from a manned or unmanned vehicle. Either single or multiple payloads and projectiles may be dropped, and if multiple payloads and/or projectiles are dropped, they may be dropped individually or in an explosively dispersed package. They can be deployed from an unmanned underwater vehicle (UUV). They can also be deployed as, or in connection with, a ballistic projectile (e.g. using a Hedge-Hog type system), or as payload on a cruise missile. The shaped charge weapons payload 100 and projectile payload 200 can also be deployed from a surface vessel such as in an over fan-tail fashion.

As alluded to above, in an embodiment, the shaped charge weapons payload 100 and projectile payload 200 are deployed in a cluster fashion. That is, a plurality of devices are deployed in the vicinity of a submarine or other target, with the anticipation that the submarine will come in contact with the devices 100 and/or 200. The sensors in the devices seek out the submarine, with the goal of attaching onto the submarine with one or more magnets. The sensor systems that can be used include active SONAR, passive SONAR, LIDAR, and mine-like magnetic and/or electromagnetic sensors. Any of the previously disclosed payloads may be deployed in this cluster modality. Passive SONAR can provide adequate bearing accuracy for the CDCs to compute the closest point of approach and perform intercept guidance. Either active SONAR or LIDAR may be used for terminal guidance and aiming. If passive SONAR is used, null steering algorithms may be employed to achieve adequate bearing accuracy.

After deployment and entry into a water column, an embodiment of the invention has a sensor system that directs the payload and/or projectile to a submarine or other target (e.g., a mine). Using the sensor, seeking, guidance, and buoyancy systems on the CDCs, the CDCs have the ability of maintaining depth, and moving up and down in the water column in order to align themselves in the path of the target. In an embodiment, the goal is for the CDCs to achieve the same depth as the target, and to place itself in the target's path. Then, one or more of the CDCs will attach itself to the target and detonate. However, in embodiments using the firing option, attachment to the target is not essential. Indeed, in some embodiments, the sensor, seeking, guidance, and buoyancy systems are able to determine if intercept is going to fail, and then determine when the closest point to the target will occur. Then, at the closest point, the payload or projectile can detonate, thereby having the greatest chance of inflicting damage to the target.

Several methods of homing logic may be deployed with embodiments of the invention. The shaped charge weapons payload 100 or projectile 200 can simply glide towards the submarine while moving up and/or down in the water. The payload 100 or projectile 200 moves up or down in the water through the buoyancy control system. However, the lifetime of the payload or projectile must be limited, so as not to violate the Geneva Convention on floating mines. Therefore, the payloads and projectiles in an embodiment are equipped with a timed self destruct system. Such a system could be as simple as a timed small explosive capable of disabling, destroying, and/or sinking the payload or projectile. The payloads and/or projectiles may be deployed ahead of the target. The payloads and/or projectiles may be deployed such that they move toward the contact position and depth of the submarine. They can also be deployed such that they loiter in the path of the submarine. In an embodiment that employs a super cavitating projectile, such as a Davis gun, the projectile may point and fire at the target during the closest point of approach if no contact is made. A CDC may maneuver in depth, and may glide forward as it rises or falls in its water column. The CDC may include control surfaces and winglets.

While the invention has been described in its preferred and other embodiments, it is to be understood that the words used are words of description rather than limitation and that changes may be made within the purview of the appended claims without departing from the true scope and spirit of the invention in its broader aspects.

The invention claimed is:

1. A depth charge comprising:

a housing;

an explosive charge within said housing;

a buoyancy control system, a sensor, and a tracking and homing system positioned completely within said housing; and a magnet, positioned within said housing, such that said depth charge is capable of becoming attached to an underwater target via said magnet;

wherein said depth charge is for deployment in an underwater environment;

wherein said sensor is for locating said underwater target in said underwater environment;

wherein said buoyancy control system and said tracking and homing system are for orienting said depth charge in proximity to said underwater target; and further wherein said buoyancy control system is configured to maintain a depth of said depth charge and move said depth charge up and down in said underwater environment.

2. The depth charge of claim 1, further comprising a detonator to detonate said explosive charge.

3. The depth charge of claim 1, wherein said housing is shaped to permit ease of attachment to a curved surface of a target.

4. The depth charge of claim 1, wherein said sensor is selected from the group consisting of passive SONAR, active SONAR, and LIDAR.

5. The depth charge of claim 1, further comprising a trigger mechanism, said trigger mechanism programmed to trigger on a particular course, at a particular speed, or at a particular depth.

6. The depth charge of claim 1, further comprising a timed self-destruct system.

7. A system comprising a plurality of depth charges, two or more of said depth charges comprising:

a housing;

an explosive charge within said housing;

a buoyancy control system, a sensor, and a tracking and homing system positioned completely within said housing; and a magnet, positioned within said housing, such that said depth charge is capable of becoming attached to an underwater target via said magnet;

wherein said two or more depth charges are for deployment in an underwater environment;

wherein said sensor is for locating said underwater target in said underwater environment;

wherein said buoyancy control system and said tracking and homing system are for orienting said two or more depth charges in proximity to said underwater target; and further wherein said buoyancy control system is configured to maintain a depth of said two or more depth charges and move said two or more depth charges up and down in said underwater environment.

8. The system of claim 7, wherein said two or more depth charges further comprise a detonator to detonate said explosive charge.

9. The system of claim 7, wherein said housing of said two or more depth charges is shaped to permit ease of attachment to a curved surface of a target.

10. The system of claim 7, wherein said two or more depth charges are deployed in said underwater environment.

11. The system of claim 7, wherein said sensor of said two or more depth charges is selected from the group consisting of passive SONAR, active SONAR, and LIDAR.

12. The system of claim 7, wherein said two or more depth charges further comprise a trigger mechanism, said trigger mechanism programmed to trigger on a particular course, at a particular speed, or at a particular depth.

13. The system of claim 7, wherein said two or more depth charges further comprise a timed self-destruct system.

* * * * *

UNITED STATES PATENT AND TRADEMARK OFFICE
Certificate

Patent No. 7,503,259 B2 Patented: March 17, 2009

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Robert J. Howard, Clifton, VA (US); and John W. Rapp, Manassas, VA (US).

Signed and Sealed this Sixth Day of July 2010.

MICHAEL J. CARONE
*Supervisory Patent Examiner*
Art Unit 3641